US008369060B2

(12) United States Patent
Wodniok

(10) Patent No.: US 8,369,060 B2
(45) Date of Patent: Feb. 5, 2013

(54) RELAY CONNECTION

(75) Inventor: Remigius Wodniok, Seligenstadt (DE)

(73) Assignee: Schneider Electric Automation GmbH, Seligenstadt (DE)

( * ) Notice: Subject to any disclaimer, the term of this patent is extended or adjusted under 35 U.S.C. 154(b) by 524 days.

(21) Appl. No.: 12/346,924

(22) Filed: Dec. 31, 2008

(65) Prior Publication Data

US 2009/0190282 A1 Jul. 30, 2009

(30) Foreign Application Priority Data

Jan. 25, 2008 (DE) ..... 10 2008 002 758

(51) Int. Cl.
*H01H 47/00* (2006.01)

(52) U.S. Cl. ..... 361/160

(58) Field of Classification Search ..... 361/160, 361/154; 307/115
See application file for complete search history.

(56) References Cited

U.S. PATENT DOCUMENTS

| | | | | |
|---|---|---|---|---|
| 3,737,720 | A * | 6/1973 | Willis, Jr. | 315/91 |
| 4,231,017 | A * | 10/1980 | Kiriyama et al. | 340/2.28 |
| 5,317,475 | A * | 5/1994 | Siepmann | 361/154 |
| 5,999,395 | A | 12/1999 | Klees | |
| 6,236,553 | B1 | 5/2001 | Videll et al. | |
| 7,535,129 | B2 * | 5/2009 | Phelps et al. | 307/115 |
| 2005/0057868 | A1 | 3/2005 | Pullmann et al. | |

FOREIGN PATENT DOCUMENTS

| | | |
|---|---|---|
| DE | 4337665 | 10/1994 |
| DE | 19715013 | 10/1998 |
| DE | 19722927 | 12/1998 |
| DE | 19751674 | 4/1999 |
| DE | 19913933 | 10/1999 |
| EP | 0874437 A2 * | 10/1998 |

* cited by examiner

*Primary Examiner* — Rexford Barnie
*Assistant Examiner* — Angela Brooks
(74) *Attorney, Agent, or Firm* — Ladas & Parry LLP

(57) ABSTRACT

A relay connection with at least two relays (K1, K2) connected in series or in parallel to a supply voltage (UV). In order to achieve a defined relay cut-out sequence should there be a dip in the supply voltage and consequently to increase safety, it is provided that the relays (K1, K2) have different minimum holding voltages (UHalt,min1; UHalt,min2) and/or inductive resistances (Rsp1; Rsp2).

2 Claims, 5 Drawing Sheets

RELAY CONNECTION

BACKGROUND OF THE INVENTION

The invention relates to a relay connection with at least two relays connected in series or in parallel to a supply voltage. In addition, the invention relates to a monitoring circuit for monitoring at least one signal input, such as an emergency stop signal, with at least two relays, which are connected in series or in parallel to a supply voltage and are controllable into an active or passive state in dependence on a signal applied at the at least one signal input.

A monitoring circuit of the abovementioned type is described in both DE-A-197 15 098 and DE-A-197 15 013.

Both cases are concerned with a safety and/or monitoring circuit for protecting a machine with several signal inputs that are monitored continuously and, if a fault occurs, the power supply to a machine is interrupted. The safety and/or monitoring circuit comprises at least two relays, which are controllable and connectable via the safety and/or monitoring circuit, as well as a start-up switch. The identical relays are series-connected and are started-up one after the other. A capacitor, the charge of which directly controls the relay, is positioned parallel to the relay to be started-up first, at least one transistor being series-connected to each of the relays, a first relay being connected to the base and a second relay connected to the collector of the transistor.

In the case of this type of circuit arrangement, identical relays, more especially with identical inductive resistance and/or identical minimum holding voltage, are used. If there is a short-term voltage dip, one of the relays may be dropped, whilst the other, however, remains operational so that the circuit arrangement has to be transferred manually into a normal state.

DE-C-43 37 665 discloses a contactor safety combination, which, through efficient utilisation of the switching members, enables a release circuit to be realised with three four-poled auxiliary contactors. In the case of the contactor safety combination, the safety or emergency stop contact is connected to the coils of the auxiliary contactors connected to the control voltage at one end. The series circuit formed by the break contacts of the second and third auxiliary contactors is connected upstream of the first coil and a series circuit formed by the make contacts of the second and third auxiliary contactors and a break contact of the first auxiliary contactor are connected upstream of the second and third parallel-connected coils. Parallel to the said series circuit, a make contact of the first auxiliary contactor is series-connected to a break contact of an ON switch.

DE-C-197 22 927 discloses a circuit arrangement with a safety function with at least two safety relays, which are connectable to a supply voltage via at least one emergency switch and the operating contacts of which are located in at least one release current circuit. In the normal operating state, the safety relays are automatically connected after excitation via a start-up switch. A capacitor is associated with each safety relay. The contacts of the safety relays are realised and positioned in such a manner that when the start-up switch is closed, one of the safety relays is excited and the capacitors are put to supply voltage and are charged, when the start-up switch is subsequently opened, the one safety relay is de-energised and the other safety relay is excited by the charging capacitor associated therewith, whereupon the one safety relay is excited by the charging capacitor associated therewith and both safety circuits move into automatic mode.

DE-A-102 16 226 discloses a device for the fail-safe disconnection of an electric consumer, more especially in industrial production plants. In a safety circuit, two contactors are connected in parallel to a single-channel connecting lead. The second connection of the contactors is connected to reference potential separately from the first safety switching device.

U.S. Pat. No. 6,236,553 describes a safety relay, which has at least one input, which is monitored for closed and open state and is connectable to the safety device and actuator, and at least one output for connection to the machine or the process, one or several stop relays for generating an interrupt and a reset circuit with at least one capacitor and one reset input. The capacitors receive and store electric power in a first state, whilst in a second state they output the power in order to reset the safety relay into a normal operating state. The safety relay also has first means, which are connected to the capacitor, which, in a first state, establish an enclosed current path between a first and a second supply voltage for charging the capacitor and, in a second state, isolate the first means from the second supply connection. Second means are positioned parallel to the capacitor for conducting current, in a second state, from the capacitor via a second supply connection to the relay coil in the stop relay in order to reset the safety relay.

DE-A-199 13 933 relates to a circuit arrangement and a method for connecting a consumer, the circuit arrangement having the following features:—a start-up circuit having a switching means for preparing at least one first control signal that is dependent on a change in a switching position of the switching means and a second control signal that is dependent on an actuating duration of the switching means;—at least one release circuit with a first control element of a first switching device having contacts and with a first switching means series-connected to the first control element for connecting the control element to a supply voltage according to the first and second control signals.

A switching arrangement with safety function is disclosed in DE-A-197 51 674, for a safety circuit with at least two relays, which are connected to a supply voltage and the operating contacts of which are inserted in at least one release current circuit.

Exclusively identical relays or respectively relay coils are not used in any of the above-mentioned citations.

SUMMARY OF THE INVENTION

Proceeding from here, it is the object of the present invention to further develop a relay connection of the aforementioned type to the extent that its safety is improved in the event of a dip in supply voltage.

The object is achieved according to the invention in that the relays have different holding voltages and/or inductive resistances.

Compared to the state of the art, this achieves the advantage that a defined cut-out sequence is achieved should there be a short-term dip in the supply voltage.

According to a preferred specific embodiment, a ratio V1 between minimum holding voltage UHalt,min1 and applied coil voltage UK1 of the first relay is greater than a ratio V2 between minimum holding voltage UHalt,min2 and applied coil voltage UK2 of the second relay.

The invention is based on the principle that the ratios V1=UHalt,min1/UK1 and V2=UHalt,min2/UK2 are different. UHalt,min is the voltage at which a relay is still responding. UK1 or respectively UK2 is the voltage applied in the circuit at relay K1 or respectively relay K2. As long as V1>>V2 applies, the relay K1 is guaranteed to be dropped the first. The principle can be applied for both series-connected and parallel-connected relays.

Another preferred specific embodiment is distinguished in that the parallel-connected relays each have a series-connected protective resistor.

BRIEF DESCRIPTION OF THE DRAWINGS

Further details, advantages and features of the invention are produced not only from the claims, the features to be found in said claims—individually and/or in combination—, but also from preferred exemplary embodiments to be found in the drawings, in which:

DESCRIPTION OF THE PREFERRED EMBODIMENTS

Figure 1:
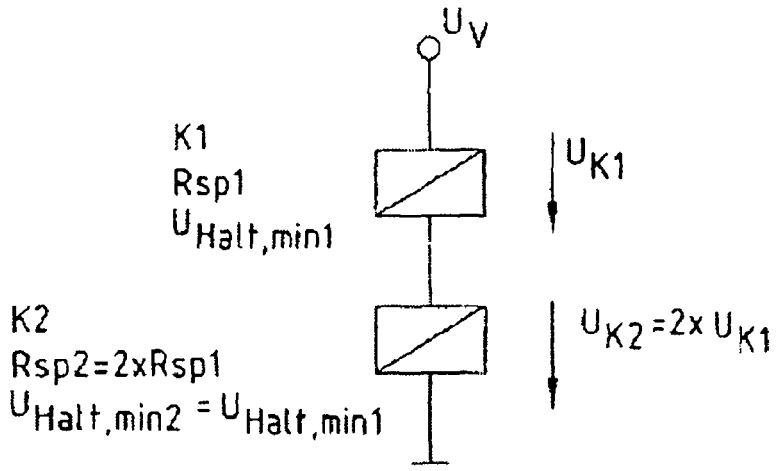
FIG. 1 shows a block diagram of a series connection of relays

FIG. 1 shows a block diagram of a series connection of a relay K1 with a relay K2. In this exemplary embodiment it is assumed that both relays K1, K2 have the same minimum holding voltage UHalt,min1=UHalt,min2. In addition, relay K1 has an inductive resistance Rsp1 and relay K2 has an inductive resistance Rsp2, which, in the exemplary embodiment, corresponds to twice the inductive resistance Rsp1, that is Rsp2=2×Rsp1.

On condition of a current 1 flowing through both relay coils K1, K2, the voltage UK1=1×Rsp1 is dropped at relay K1 and the voltage UK2=1×2×Rsp1=2×UK1 is dropped at relay K2. Where VI=50%, then the following applies:

$$VI = U\text{Halt,min1}/UK1\ 50\% >> V2\ U\text{Halt,min2}/UK2\ \tfrac{1}{2}\ U\text{Halt,min1}/UK1\ 25\%$$

The result of this is that where there is a dip in supply voltage UV, the relay K1 is dropped the first, as VI>>V2.

Figure 2:
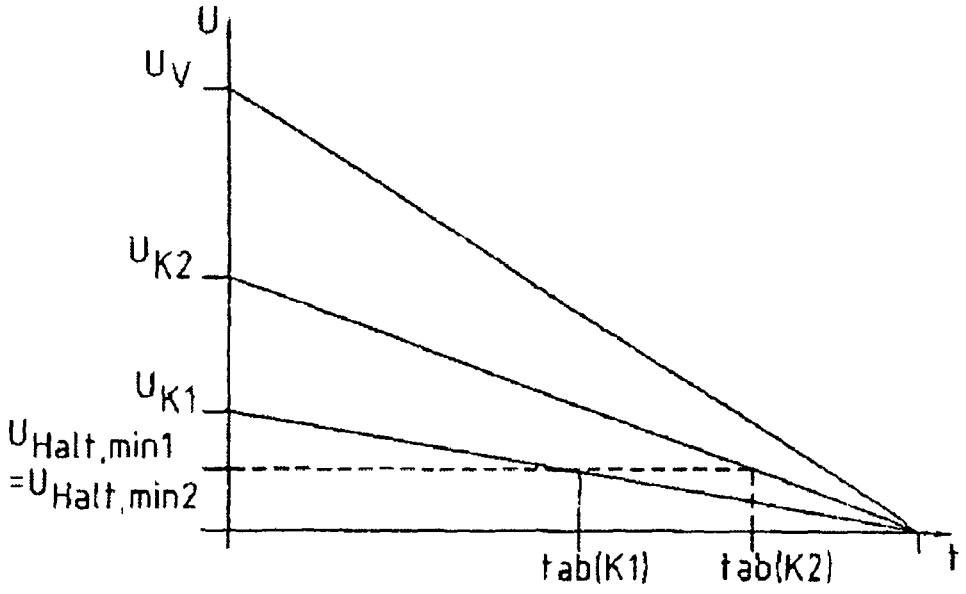
FIG. 2 shows a diagram with voltage curves for supply voltage and applied coil voltages

FIG. 2 shows a drop in the supply voltage UV over the time t. In addition, the voltage drops UK1 and UK2 at the relay coils are represented, with the assumption that the resistance Rsp2 of the relay K2 is double the size of the inductive resistance Rsp1 of the relay 1. In this respect, the voltage drop UK2 at relay K2 is double the size of the voltage drop UK1 at relay K1.

With the additional requirement that the minimum holding voltages are identical, that-is-to-say UHalt,min1=UHalt, min2, the cut-off time $t_{ab}$ (K1) is produced for relay K1 and the cut-off time $t_{ab}$ (K2) for relay K2, $t_{ab}$ (K1) being less than $t_{ab}$ (K2).

This is also illustrated by the following equations:

$$V1 >> V2$$

$$U\text{Halt,min1}/UK1 >> U\text{Halt,min2}/UK2$$

$$U\text{Halt,min1}/(I \times RK1) >> U\text{Halt,min2}/(I \times RK2)$$

Figure 3:
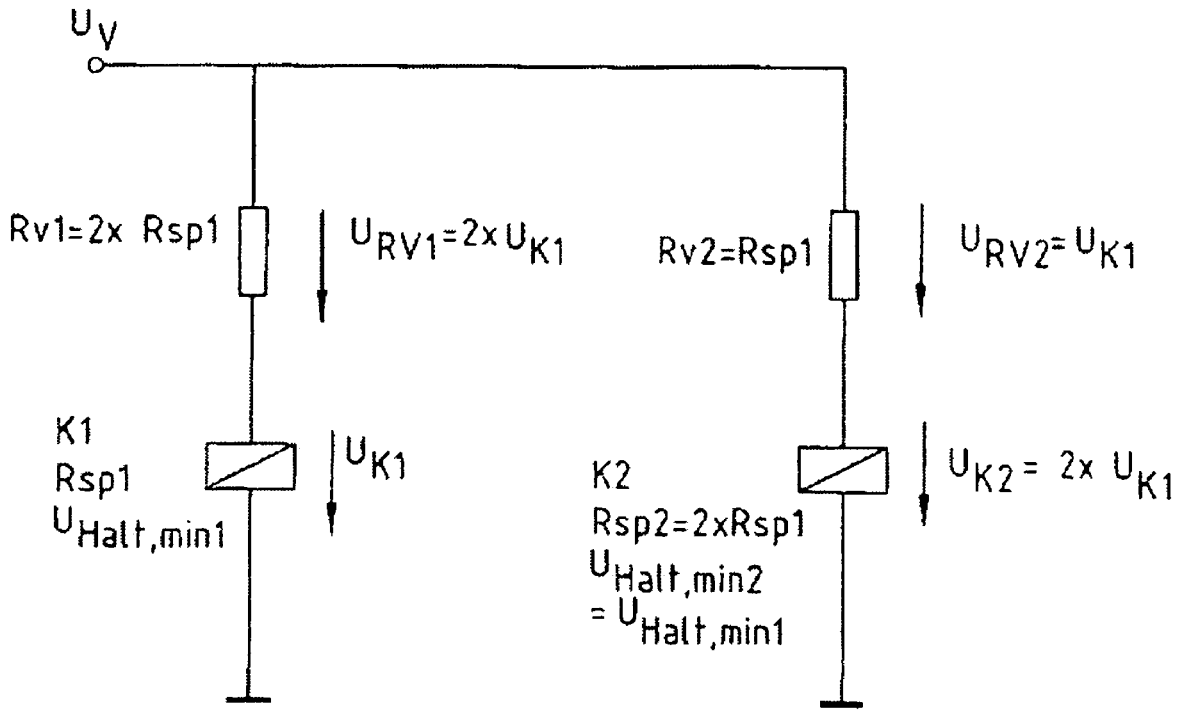
FIG. 3 shows a block diagram of a parallel connection of relays with protective resistor and FIG. 4 shows a schematically represented monitoring circuit with current flows in a first phase

FIG. 3 shows the block diagram of a parallel connection of relay K1 and K2. In this case, a protective resistor Rv1 or respectively Rv2 is connected upstream of each relay and with the corresponding dimensioning said protective resistors provide that where the supply voltage UV is lowered, more especially short-term lowering, a defined cut-off sequence is achieved.

It is also assumed with this example that the relays K1, K2 have minimum holding voltage UHalt,min1=UHalt,min2 and that relay K1 has an inductive resistance Rsp1 and relay K2 an inductive resistance Rsp2, which is twice the size of the inductive resistance Rsp1, that is to say Rsp2=2×Rsp1. In addition, the ratio between the protective resistors Rv1 or respectively Rv2 is Rv1=2×Rsp1 and Rv2=Rsp1. This produces a voltage drop UK2 at relay K2 of UK2=2×UK1. In addition, where VI is 50%, the following ratios are produced:

$$VI = U\text{Halt,min1}/UK1 = 50\% >> V2 = U\text{Halt,min2}/UK2 = \tfrac{1}{2} U\text{Halt,min1}/UK1 = 25\%$$

The result of this here too is that if there is a dip in the supply voltage UV, relay K1 is dropped the first, as VI>>V2.

Figure 4:
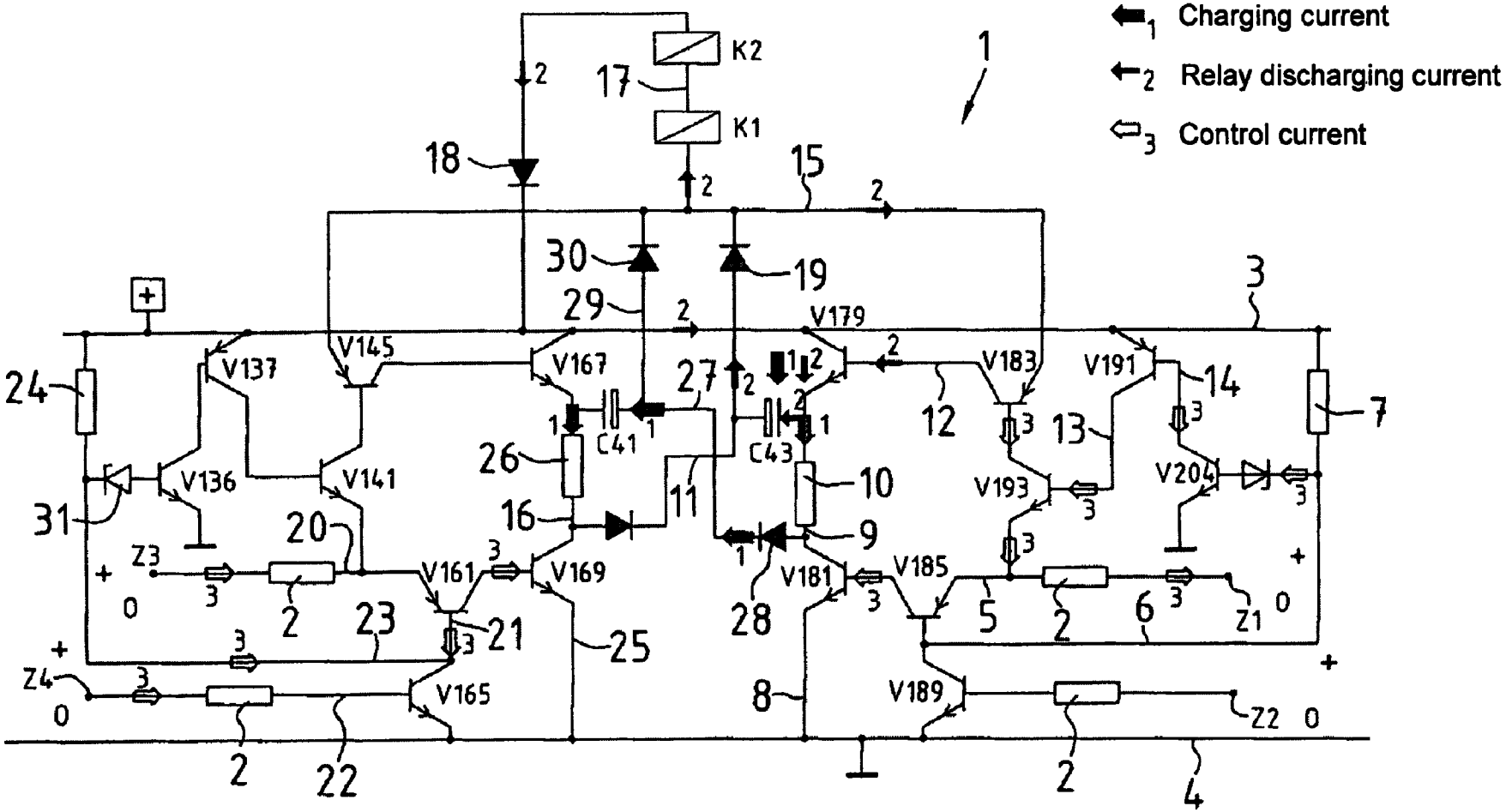
Figure 5:
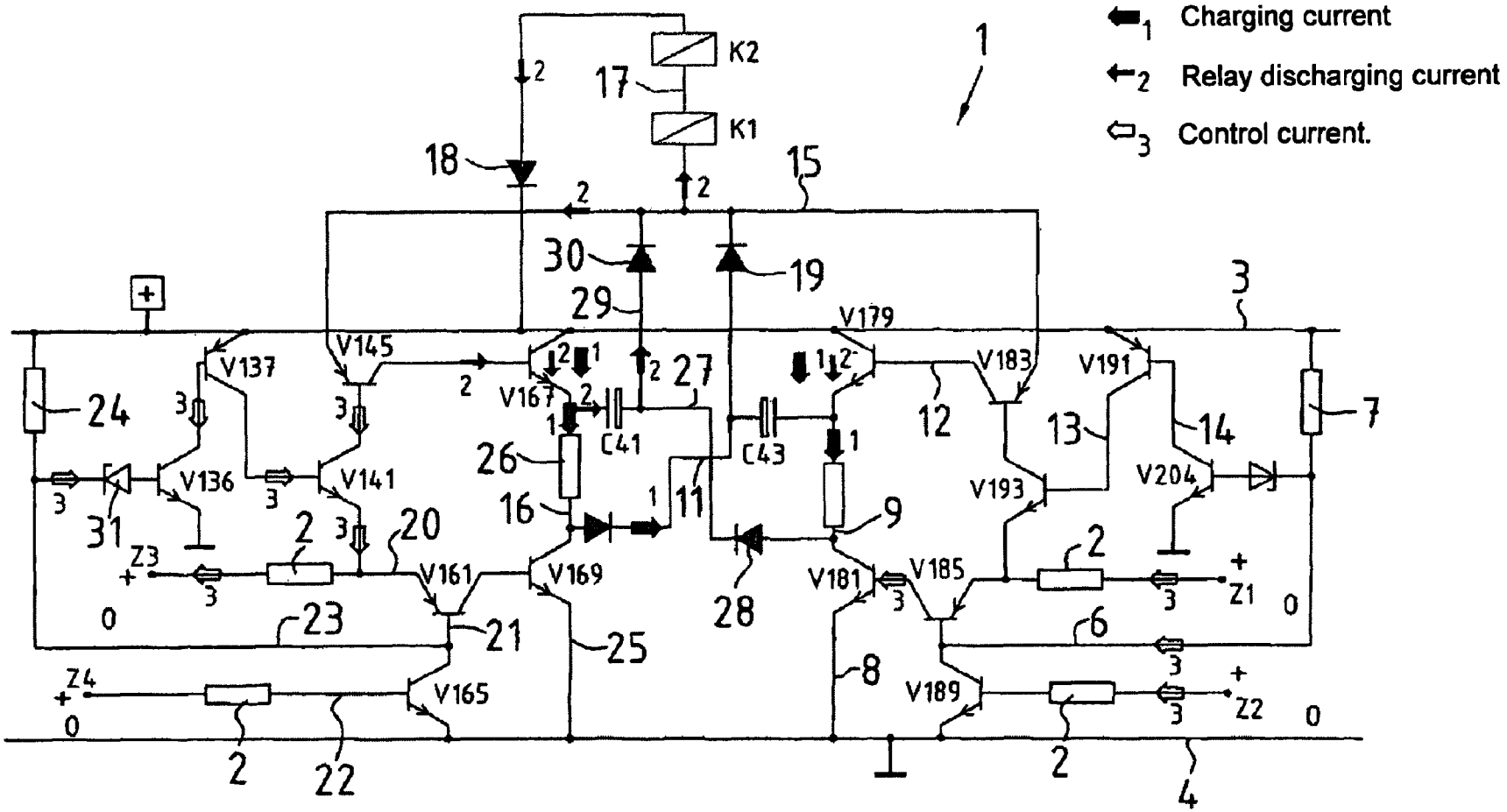
FIG. 5 shows the monitoring circuit in FIG. 3 in a second phase and FIG. 6 shows a circuit, connected to the monitoring circuit in FIGS. 3 and 4, of two relays for the start-up of an external machine.

FIGS. 4 and 5 represent a monitoring circuit 1. The monitoring circuit 1 has four signal inputs Z1, Z2, Z3 and Z4. Each signal input Z1, Z2, Z3 and Z4 is connected to a resistor 2.

In addition, a positive power lead 3 and a negative power lead 4 are represented in FIGS. 4 and 5.

The signal input Z1 is connected to a transistor V185 on the emitter side via a lead 5. The base of the transistor is connected on one side via a lead 6 to the positive power lead with the intermediate connection of a resistor 7 and on the other side to the collector of a transistor V189, which transistor V189 is connected on the emitter side to the negative power lead 4 and with its base with the intermediate connection of the resistor 2 to the signal input Z2.

The transistor V185 abuts by means of its collector against the base of a transistor V181, which is connected on the emitter side via a lead 8 to the negative power lead 4 and on the collector side to a lead 9. A resistor 10 is wired into the lead 9, a capacitor C43 being wired in parallel to said resistor, the capacitor being in the form of a polarised electrolytic capacitor, the negative plate of which is connected to the lead 9 and the positive plate of which is connected to a lead 11. In addition, a transistor V179 with its emitter is connected into the lead 9, said transistor being connected on the collector side to the positive power lead 3.

The base of the transistor V179 is connected to the collector of a transistor V183 via a lead 12. The transistor V183, once again, is connected by its base to a collector of a transistor V193, the emitter of which is connected to the lead 5 and the base of which is connected via a lead 13 to the collector of a transistor V191. The transistor V191 is connected on the emitter side to the negative power lead 4 and on the side of its base via a lead 14 to the collector of a transistor V204. The base of said transistor V204 is connected via a Z diode to the lead 6.

The transistors V189, V181, V179, V193 and V204 are NPN transistors, whereas the transistors V191, V183 and V185 are PNP transistors.

The lead 11 connects a lead 15 to a lead 16, which is also described below.

The lead 15 is connected on the emitter side to the transistor V183 and to a transistor V154. In addition, a lead 17 is connected to the lead 15, into which lead 17 two relays K1 and K2 are series-connected and which is connected on the other side to the positive power lead 3. A diode 18 is wired into the lead 17 and an additional diode 19 is wired into the lead 11.

The above-described right-hand side of the monitoring circuit 1 is also analogously the left-hand side of the monitoring circuit 1 for the signal inputs Z3 and Z4. The signal input Z3 is connected via a lead 20, into which the resistor 2 is wired, on the emitter side to a transistor V161, which transistor V161 is connected to the collector of a transistor V165 via a lead 21. A lead 22, which connects the base of the transistor V165 to the signal input Z4, is connected to the base of the transistor V165. On the emitter side, the transistor V165 is connected to the negative power lead 4.

A lead 23, which is connected to the positive power lead 3 and into which a resistor 24 is wired, is connected to the lead 21 between the base of the transistor V161 and the collector of the transistor V165.

The collector of the transistor V161 is connected to the base of a collector V169, which is wired on the emitter side via a lead 25 to the negative power lead 4 and with its collector is series-wired to a resistor 26 and a capacitor C41. The capacitor C41, once again, is realised as a polarised electrolytic capacitor, the positive plate of which is connected to the lead 9 via a lead 27, a diode 28 being positioned in the lead 27. The lead 27 is also connected via a lead 29 with activated diode 30 to the lead 15.

The emitter of a transistor V167 is connected between the capacitor C41 and the resistor 26, the collector of said transistor being connected to the positive power lead and its base to the emitter of the aforementioned transistor V145. The transistor V145 is—as already mentioned—connected on the emitter side to the lead 15. The base of the transistor V145 abuts against the collector of a transistor V141, which is connected on the emitter side to the lead 20. The base of the transistor V141 is connected to the collector of a transistor V137, which, in its turn, is connected to the positive power lead 3 via its emitter. The base of the transistor V137 is connected to the collector of a transistor V136, the base of which, with the intermediate connection of a Z-diode 31, is connected to the lead 23, the resistor 24 being series-wired to the diode 31.

The charging current, the relay charging current and the control current in the monitoring circuit are represented in a first phase in FIG. 4. The charging current, in this case, is indicated by an arrow with the number 1, the relay charging current by an arrow with the number 2, and the control current by an arrow with the number 3. In this first phase, there is a positive potential at the signal inputs Z3 and Z4 and a zero potential at the signal inputs Z1 and Z4. The capacitor C43 is charged and the capacitor C41 discharged.

Through the potentials applied at the signal inputs Z3 and Z4, the transistors V161, V165 and V169 are directly controlled. The corresponding charging currents are given in leads 20, 21 and 22.

The transistor V204 is conductive through the zero potentials of the signal inputs Z1 and Z2. The base current of the transistor V191, the collector current of which once again directly controlling the base of the transistor V193, flows via the said transistor V204. The transistor V193 can only conduct if the potential at the signal input Z1 is zero. In this case, the base current of the transistor V183, which is fed from the capacitor C43, flows through the transistor V193. The base current of the transistor V179 flows via the collector-emitter section of the transistor V183.

In this state, the transistors V169 and V179 are directly controlled such that the relay? C43 discharges into the relays K1 and K2. The discharging is effected via the transistor V179, the discharging also supplying the base current for the transistors V179 and V183.

At the same time as the discharging of the capacitor C43, the capacitor C41 is charged via the transistors V179 and V169. The charging of the capacitor C41 is effected through the potential at the signal inputs Z3 and Z4.

In the second phase shown in FIG. 5, said phase alternating with the first phase shown in FIG. 4 every 2.3 ms, the transistors V181, V185 and V189 are directly controlled as now the signal inputs Z1 and Z2 have a potential and the signal inputs Z3 and Z4 a zero potential. The transistor V136 conducts through the zero potentials in the signal inputs Z3 and Z4. The base current of the transistor V137, the collector current of which once again directly controls the base of the transistor V141, flows via said transistor V136. The transistor V141 can only conduct if the potential at the signal input Z3 is zero.

The base current of the transistor V145, which is fed from the capacitor C41, flows through the transistor V141. The base current for the transistor V167 flows via the collector-emitter section of the transistor V145.

In this phase, the transistors V167 and V181 are directly controlled. In this case, the capacitor C41 discharges into the relays K1 and K2 via the transistor V167. In addition, the capacitor C41 supplies the base current for the transistors V167 and V145. At the same time as the discharging of the capacitor C41, the capacitor C43 is recharged via the transistors V167 and V181.

The afore-described phases are repeated every 2.3 ms so that constant monitoring of the signal inputs Z1, Z2, Z3 and Z4 takes place. Should a potential not have the relevant size and/or polarisation during monitoring, the capacitor is not charged so that the said capacitor cannot then discharge into the relays K1 and K2. The relays K1 and K2 are then accordingly dropped so that the machine connected thereto likely to cause danger is immediately shut down. In the event of a fault in a component, the transistors V167, V169, V179 and/or V181 burn so that the entire control system shuts down and also avoids charging a capacitor, with the result that in the connecting phase the said capacitor cannot be discharged into the relays K1 and K2.

In order originally to activate the monitoring circuit 1 shown in FIGS. 4 and 5 and explained above, a start-up procedure is necessary which is executed via a circuit 32, as is represented in FIG. 5.

Figure 6:
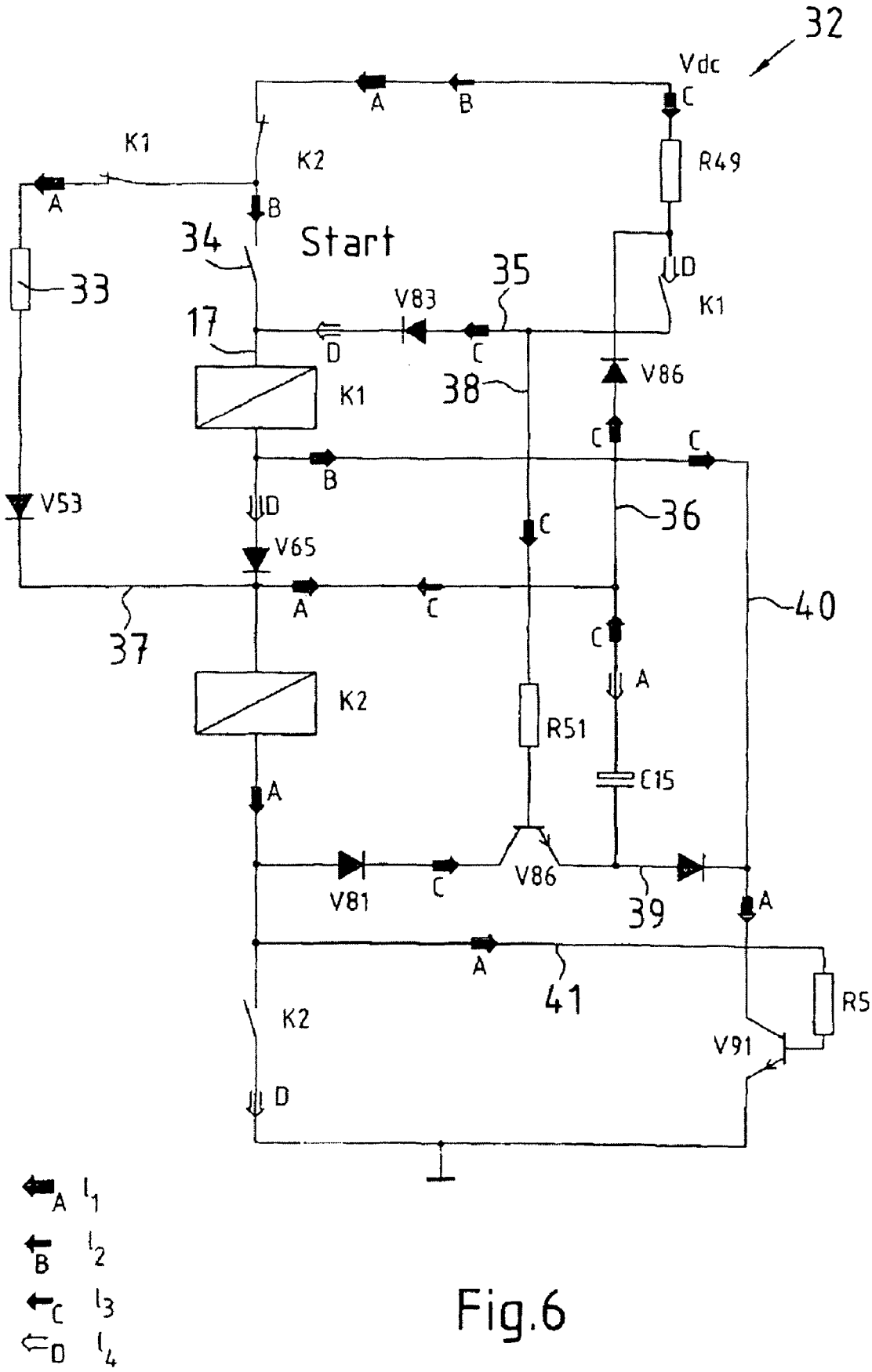

FIG. 6 represents the lead 17 with the activated relays K1 and K2. The relays K1 and K2 are series-wired with the intermediate connection of a diode V65. A resistor 33 and a diode V53 are wired parallel to the relay K1. A make contact of the relay K1 is wired upstream of the resistor 33. The make contact of the relay K2, contrary to this, is series-wired to a switch 34 for the external start-up procedure. The break contact of the relay K2 is wired into the lead 17, whereas the break contact of the relay K1 is inserted into a lead 35 connected to the lead 17, said lead 35 being connected to the make contact of the relay K2 via a resistor R49. A diode V83 is also positioned in the lead 35, the break contact being positioned between the resistor R49 and the diode V83. A diode V86 and a capacitor C15 are wired into a lead 36 connected between resistor R49 and the break contact of the relay K1. A lead 37, which is connected on one side to the lead 17 and on the other side to the resistor 33, is connected between the capacitor C15 and the diode V86.

A lead 38, which connects the lead 35 to the transistor V85, is positioned parallel to the lead 36, the lead 38 being connected to the base of the transistor V85. On the collector side, the transistor V85 is connected to the lead 17 between the relay K2 and the break contact of the relay K2, whereas, contrary to this, the emitter of the transistor V85 is connected to a lead 39, to which the lead 36 with the capacitor C15 is also connected. The lead 39 is also connected via a lead 40 to the lead 17 between the two relays K1 and K2.

A lead 41, into which a resistor R57 is wired, is positioned parallel to the lead 39. The lead 41 connects the lead 17 to the base of a transistor V91, which is wired into the lead 40 on the collector side.

The external start-up is divided into four phases, which must be forcibly executed one after the other. The four phases are illustrated in FIG. 5 by the currents 11, 12, 13 and 14, an arrow with the capital letters A to D being associated with each current.

In the first phase, the capacitor C15 is charged via the two break contacts of the relays K1 and K2. In this case, the base current of the transistor V91 flows through the relay K2. The charging of the capacitor C15 is necessary to control the relay K2 directly. In the second phase, the switch 34 is actuated so that the relay K1 is supplied with voltage. The current, in this case, flows through the relay K1 and the transistor V91. This phase represents the start-up instruction.

Once the relay K1 has moved into the self-maintaining state following the start-up instruction, the current flows via the resistor R49, the relay K1 and the transistor V91. The make contact of the relay K1, in this case, directly controls the base of the transistor V85. This means the capacitor C15 is discharged by the relay K2. The capacitor C15 also supplies the transistor V85 with an additional base current. In this third phase the relay K1 is in the self-maintaining state.

In the fourth and final phase, the relay K2 responds. As soon as the relay K2 has responded, the transistor V91 is blocked and the holding current flows via the two make contacts of the relays K1 and K2.

With this start-up circuit 32, the relays K1 and K2 are consequently not started-up simultaneously but rather one after the other. This type of start-up is cheaper and more effective compared to the state of the art and provides for complete monitoring both of the start-up circuit 32 and also of the machine it is starting-up.

By using different relays K1, K2, that-is-to-say with different minimum holding voltage UHalt,min1, UHalt,min2 and/or different inductive resistances Rsp1, Rsp2, the advantage achieved is that the relays, in the case of a short-term dip in the supply voltage, are dropped or respectively are cut-out in a defined sequence. By selecting the relay parameters, such as holding voltage UHalt and inductive resistance Rsp, the ratio VI=UHalt,min1/UK1 or respectively V2=Uhalt,min2/UK2 can be adjusted. As long as V1>>V2, the relay K1 is always guaranteed to be released in time sequence before the relay K2.

The achievement of the defined relay cut-out sequence is that relay K1 is dropped first of all, whilst relay K2 is still responding. Through the premature drop-out of the relay K1, the self-maintaining make contact K1 is opened (FIG. 5), the voltage supply for the relays thereby being interrupted, which then also forcibly results in a drop-out of the relay K2, so that the circuit is in a defined state.

A premature cut-out of the relay K2 in the event of a short-term dip in the supply voltage is hereby excluded. However, in the case of a circuit arrangement according to the state of the art, this would lead to the relay K2 dropping-out, but relay K1 remaining in self-acting mode, resulting in an undefined state which can only be reset manually. This is, however, connected with considerable safety misgivings.

What is claimed is:

1. A monitoring circuit for monitoring at least one signal input, such as an emergency stop signal, comprising:

at least first and second relays (K1, K2) connected in series or in parallel to a DC-supply voltage (Vdc) and controlled into an active state by means of a start-up switch;

wherein the relays are connected to the supply voltage (Vdc) by means of a self-maintaining contact of relay, and into a passive state in dependence on the signal applied at the least one signal input;

wherein said first and second relays (K1, K2) have different ohmic coil resistances (Rsp1, Rsp2); and wherein the coil resistance (Rsp1) of said first relay (K1) is smaller than the coil resistance (Rsp2) of said second relay (K2), so that in the case of a short-term dip in the supply voltage (Vdc), said first relay (K1) is dropped first, while said second relay (K2) is still responding.

2. A monitoring circuit according to claim 1, wherein a ratio between minimum holding voltage and applied coil voltage of said first relay is greater than a ratio between minimum holding voltage and applied coil voltage of said second relay.

* * * * *